US008099904B2

(12) United States Patent
Saccon

(10) Patent No.: US 8,099,904 B2
(45) Date of Patent: Jan. 24, 2012

(54) MECHANISM FOR THE INSTALLMENT OF A DOOR OR OTHER SIMILAR CLOSURE HAVING A ROTATIONAL-SLIDING MOVEMENT

(75) Inventor: Sandro Saccon, Santa Maria di Sala (IT)

(73) Assignee: Rigo Sandra, Santa Maria di Sala (IT)

( * ) Notice: Subject to any disclaimer, the term of this patent is extended or adjusted under 35 U.S.C. 154(b) by 702 days.

(21) Appl. No.: 11/989,777

(22) PCT Filed: Sep. 8, 2006

(86) PCT No.: PCT/EP2006/066177

§ 371 (c)(1),
(2), (4) Date: Jan. 31, 2008

(87) PCT Pub. No.: WO2007/039401

PCT Pub. Date: Apr. 12, 2007

(65) Prior Publication Data

US 2009/0265887 A1 Oct. 29, 2009

(30) Foreign Application Priority Data

Sep. 23, 2005 (IT) ..... PD2005A0275

(51) Int. Cl.
*E05D 15/28* (2006.01)

(52) U.S. Cl. ..... 49/246; 49/247; 49/248; 49/250; 49/252; 49/260

(58) Field of Classification Search ..... 49/246, 49/247, 261, 248–255, 257, 258, 260, 152–156; 16/366, 368, 369, 370, 92, 93 R, 97, 98, 102, 16/106, 107, 87 B; 244/129.1, 129.4, 129.5
See application file for complete search history.

(56) References Cited

U.S. PATENT DOCUMENTS 1,108,335 A * 8/1914 Carter ..... 5/147
(Continued)

FOREIGN PATENT DOCUMENTS

JP 63-103180 5/1988
(Continued)

*Primary Examiner* — Katherine Mitchell
*Assistant Examiner* — Catherine A Kelly
(74) *Attorney, Agent, or Firm* — Modiano & Associati; Alber Josif; Daniel O'Byrne

(57) ABSTRACT

A mechanism for the installment of a door or other similar closure having a rotational-sliding movement, of the type comprising the following elements to associate to a shutter: first pivot means defining a first vertical axis for the pivoting of a shutter, in a substantially central region thereof, to translation means arranged so as to slide in a corresponding guide associated to the upper strut of a frame of a door; second pivot means with an axis parallel to the axis of the first pivot means, for the pivoting of two arms, a first upper one and a second lower one, that are both pivoted with one of their ends to the frame of the door or closure in proximity to a jamb to define a second rotation axis, and have the opposite ends reciprocally rigidly coupled by means of a rod, defining a third rotation axis interposed between the first axis and the second axis, passing through the shutter in the direction of the height thereof. The second pivot means are rigidly coupled to the frame with means for adjusting the distance of the second rotation axis from the nearby jamb of the door or the like; further the rod is fixed to at least one of the two arms with a rigid connection device that provides a non-welded joint between the rod and the arms. Such mechanism according to the invention facilitates and improves the installment of doors having a rotational-sliding movement.

17 Claims, 6 Drawing Sheets

U.S. PATENT DOCUMENTS

| | | | | | |
|---|---|---|---|---|---|
| 1,632,333 | A | * | 6/1927 | Healy | 49/246 |
| 2,019,527 | A | * | 11/1935 | Ellison | 49/252 |
| 2,842,795 | A | * | 7/1958 | Majeske | 16/245 |
| 3,479,684 | A | | 11/1969 | Abbott | |
| 3,605,339 | A | | 9/1971 | Catlett et al. | |
| 3,925,933 | A | * | 12/1975 | Reuter | 49/409 |
| 4,106,158 | A | * | 8/1978 | Kellems et al. | 16/238 |
| 4,286,411 | A | * | 9/1981 | Wikkerink et al. | 49/252 |
| 5,042,555 | A | * | 8/1991 | Owens | 160/199 |

FOREIGN PATENT DOCUMENTS

| | | |
|---|---|---|
| JP | 6-78567 | 11/1994 |
| JP | 11-101055 | 4/1999 |

* cited by examiner

MECHANISM FOR THE INSTALLMENT OF A DOOR OR OTHER SIMILAR CLOSURE HAVING A ROTATIONAL-SLIDING MOVEMENT

The present invention relates to a mechanism for the installment of a door or other similar closure having a rotational-sliding movement.

BACKGROUND OF THE INVENTION

Currently doors that are openable/closable by means of a rotational-sliding movement are known.

Such doors are generally arranged by associating to a shutter the following elements:

first pivot means defining a first vertical axis for the pivoting of the shutter, in a substantially central region thereof, to translation means arranged so as to slide in a corresponding guide associated to the upper strut of the frame of the door;

second pivot means with an axis parallel to the axis of the first pivot means, for the pivoting of two arms, a first upper one and a second lower one, each of which is pivoted with one end to the frame of the closure in proximity to a jamb to define a second rotation axis, said arms having the opposite ends reciprocally rigidly connected by means of a rod defining a third rotation axis, interposed between the first and second axes, passing through said shutter in the direction of the height thereof.

By means of such mechanism the push imposed by a user to the shutter for opening the door, for example towards the outside, makes the shutter rotate about the first axis, such rotation bringing about the contemporary rotation of the arms about the third axis in the opposite direction with respect to the shutter.

The second axis, about which both the shutter and the arms rotate, is made by said arms to travel along a circular-arc trajectory with respect to the third axis, in the opposite direction with respect to that of the opening of the shutter.

Contemporarily, the first axis slides parallel to itself, thanks to the sliding means, towards the jamb to which the arms are connected.

Such movement provided to the shutter by the mechanism, as shown schematically in FIG. 10, allows to reduce the volume spanned with a usual movement of opening or closing with respect to a normal hinging of the shutter to a jamb of a door.

The movement just described brings about considerable advantages when several doors must be installed one near the other, for example on converging walls, in which case such doors, if both open, could inconveniently block the correct and complete opening of one with respect to the other, and vice-versa.

Moreover, the shutters of the rotating-sliding doors are generally openable on both sides, further facilitating the passage through such doors and allowing the user to choose the most convenient opening of the shutter with a pushing movement or with a pulling movement.

The doors provided with such mechanism, moreover, are particularly employed in hospital and meeting-place environments, but also in domestic environments, that must be used by handicapped persons; in fact the progressive reduction of the distance between the user and the handle of the shutter renders the opening of the door much more simple, allowing the user, for example seated in a wheel chair or supported by crutches, to avoid leaning dangerously from a balanced position.

A mechanism as described above is the subject of Italian patent application for utility model No. VE92U000026, filed on 10 Aug. 1992 in the name of this same applicant.

Such mechanisms for the arrangement of doors with rotational-sliding movement are sometimes difficult to provide for a technician who must mount them on doors or other closures that have different dimensions.

SUMMARY OF THE INVENTION

The aim of the present invention is to provide a mechanism for the installment of a door or other similar closure with rotational-sliding movement that may be adapted, with few and simple mechanical elaborations, to doors or other closures of different dimensions.

Within this aim, an object of the present invention is to provide a mechanism that allows an easy registration of the position of the shutter with respect to the jambs.

A further object of the present invention is to provide a mechanism that can be arranged in any position with respect to the width of the wall in which the door is provided.

Another object of the present invention is to provide a mechanism that is applicable to shutters having different heights.

Another object of the present invention is to provide a mechanism that is easily arranged also by personnel that is not provided with particular skills.

Another object of the present invention is to provide a mechanism that can be manufactured economically with known systems and technologies.

This aim and these and other objects, that will become better apparent hereinafter, are achieved by a mechanism for the installment of a door or other similar closure having a rotational-sliding movement, of the type comprising the following elements to associate to a shutter or the like:

first pivot means defining a first vertical axis for the pivoting of the shutter or the like, in a substantially central region thereof, to translation means arranged so as to slide in a corresponding guide associated to at least one upper or lower strut of the frame of the door or other similar closure;

second pivot means with an axis parallel to the axis of said first pivot means, for the pivoting of two arms, a first upper one and a second lower one, that are both pivoted with one of their ends to the frame of the closure in proximity to a jamb to define a second rotation axis, and have the opposite ends rigidly coupled to the shutter or the like so as to define a third rotation axis, interposed between the first and second axes, passing through the shutter in the direction of the height thereof, said mechanism being characterized in that said second pivot means are rigidly coupled to the frame with means for adjusting the distance of said second rotation axis from the nearby jamb of the door or the like, said opposite ends being reciprocally rigidly coupled by means of a rod passing through the entire height of the shutter and defining the third rotation axis, said rod being fixed to at least one of the two arms with a rigid connection device adapted to provide a non-welded joint between the rod and the arm.

BRIEF DESCRIPTION OF THE DRAWINGS

Further characteristics and advantages of the invention will become better apparent from the following detailed description of two preferred but not exclusive embodiments thereof, illustrated by way of non-limiting example in the accompanying drawings, wherein.

DESCRIPTION OF THE PREFERRED EMBODIMENTS

Figure 1:
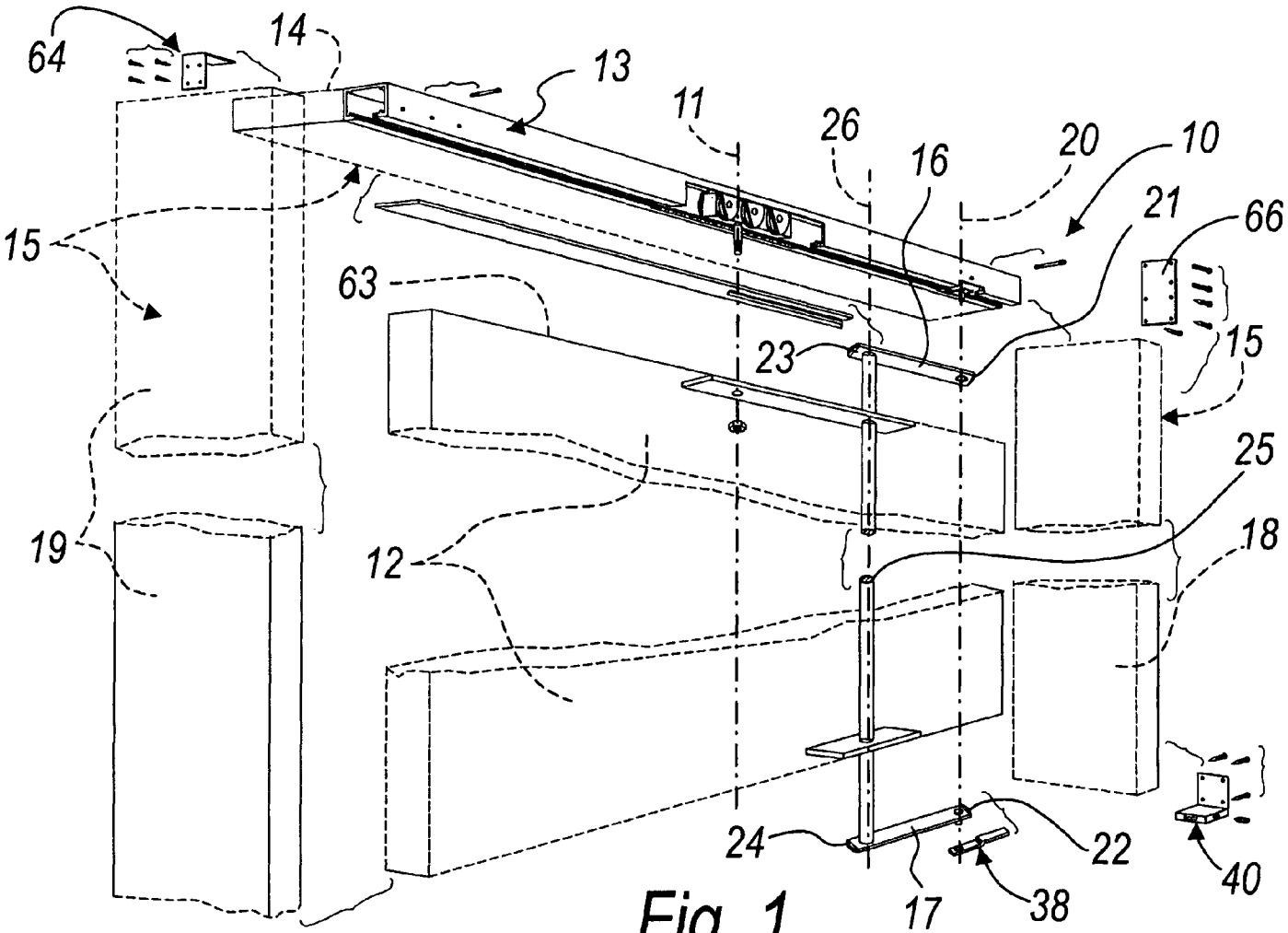
FIG. 1 is an exploded perspective view of a mechanism according to the invention in a first embodiment thereof, applied to a door.
Figure 2:
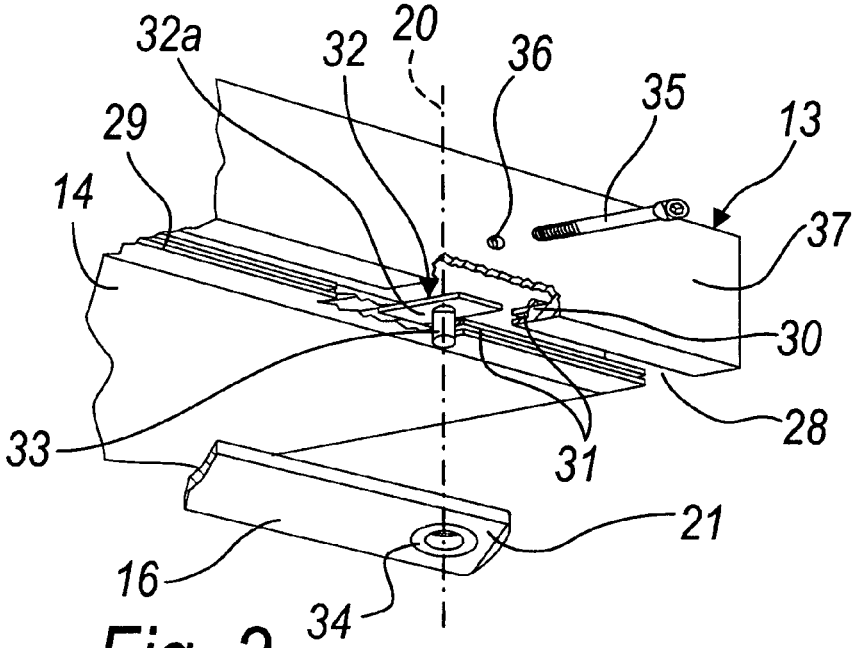
FIG. 2 is an exploded partially sectional perspective view of a first detail of the mechanism according to the invention.

With reference to the figures, a door installed with a mechanism according to the invention is designated by the reference numeral 10 in a first embodiment thereof, illustrated in FIGS. 1 to 7.

The mechanism, applied to the door 10 in a non-limiting example of the invention, comprises the following elements to associate to a shutter 12 and to a frame 15 surrounding the shutter:

- first pivot means defining a first vertical axis 11 for the pivoting of the shutter 12, in a substantially central region thereof, to translation means arranged so as to slide in a corresponding guide 13 associated to an upper strut 14 of the frame 15 of the door 10;
- second pivot means with an axis parallel to the axis of said first pivot means, for the pivoting of two arms, a first upper one 16 and a second lower one 17, that are both pivoted with one of their first ends, respectively 21 and 22, to the frame 15 in proximity to a first jamb 18; such second pivot means define a second rotation axis 20, and have the opposite second ends, respectively 23 and 24, reciprocally rigidly connected by means of a rod 25, that defines a third rotation axis 26, interposed between the first axis 11 and the second axis 20; the rod 25 passes through the shutter 12 in the direction of the height thereof.

The rod 25 is constituted by a tubular profiled element with a circular section.

The frame 15 is therefore composed by two jambs 18 and 19 and by the strut 14.

The second pivot means are rigidly coupled to the frame 15 with means for adjusting the distance of the second rotation axis 20 from the nearby jamb 18.

In the embodiment described here, the rod 25 is fixed to the lower arm 17 with a rigid connection device 27, better described hereinafter, adapted to provide a non-welded joint between the rod 25 and the arm 17.

The mechanism also comprises means for adjusting the distance between the two jambs 18 and 19 of the frame 15.

The guide 13 is constituted by a profiled element rigidly coupled to the upper strut 14 and having a substantially C-shaped cross section, with an opening 28 directed downward.

A longitudinal groove 31 is provided on each one of the facing edges 29 of wings 30 of the profiled element defining the opening 28.

The means for adjusting the distance of the second rotation axis 20 from the nearby jamb 18 are constituted, for the first upper arm 16, by a plate 32, of which two opposite perimetral portions 32*a* are adapted to be inserted in the facing longitudinal grooves 31.

A first cylindrical body 33 protrudes from the plate 32 and is adapted to be inserted in a counter-shaped first rotation ring 34 rigidly coupled to the first end 21 of the first arm 16.

The plate 32 is movable in the grooves 31 in the longitudinal extension direction of the profiled element, for registering its position.

The chosen position is fixed by means of a first threaded element 35 passing at corresponding holes 36 open on two facing vertical walls 37 of the profiled element near the region in which the plate 32 is inserted.

The threaded element 35, for example a screw with a hollow head, is adapted to tightly hold the profiled element locking the plate 32 between the two facing wings 30.

The means for adjusting the distance of the second rotation axis 20 from the nearby jamb 18 are constituted, for the second lower arm 17, by a first plate-shaped element 38 inserted with a first part 38*a* thereof inside an opening 39 of a plinth 40 fixed below the jamb 18, and protruding with its remaining second part 38*b* to support a second cylindrical body 41.

The second cylindrical body 41 is adapted to be inserted in a counter-shaped second rotation ring 42 rigidly coupled to the facing end 22 of the second arm 17.

The first plate-shaped element 38 is slideable inside the opening 39 towards the inside or towards the outside of the plinth 40 for positioning the cylindrical body 41, so that said cylindrical body is coaxial with the first cylindrical body 33 to define the second rotation axis 20.

The position of the second cylindrical body 41 is fixed by means of a second threaded element 43, for example a dowel bolt, screwed in a counter-threaded hole provided on the plinth 40 and open on the opening 39 with an axis traverse to the longitudinal direction of the opening 39.

The threaded element 43 is screwed until it presses against a side of the first part 38*a* of the plate-shaped element 38.

In the embodiment of the invention here described, the plinth 40 is fixed to the jamb 18 by means of four screws 65 arranged to block a plate-shaped portion 40*a* rigidly to the plinth 40 and at right angles thereto.

Figure 7:
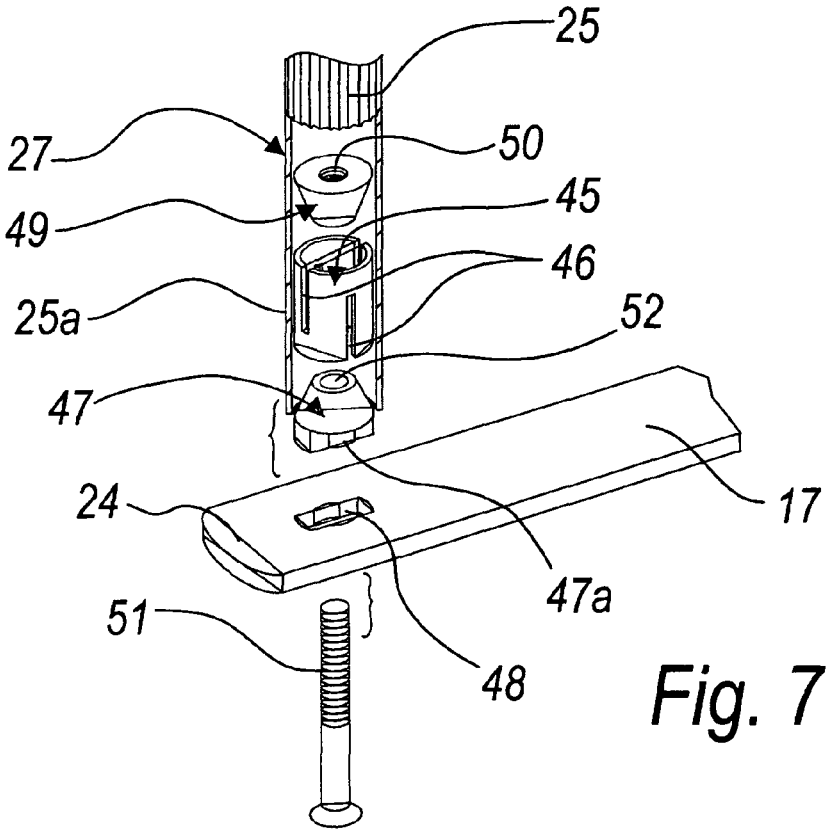
FIG. 7 is an exploded perspective view of the rigid connection device according to the invention.

The rigid connection device 27 adapted to provide a non-welded joint between the rod 25 and the second arm 17, as shown in FIG. 7, is constituted by an expanding cylindrical tubular insert 45 with longitudinal grooves 46 open on the ends.

The rod 25 is a tubular element with a circular cross-section.

In order to expand the insert 45 and hold it on the inside of the end of the rod 25, there are coaxially connected thereto:

- a first frustum-shaped wedge block 47, inserted in the end 25*a* of the rod 25 with the conical part facing the cylindrical insert 45, and provided with an anti-rotation tongue 47*a* protruding from the end 25*a* of the rod 25 and adapted to be inserted in a counter-shaped seat 48 open on the corresponding end of the arm 17;

a second frustum-shaped wedge block 49, opposite to the first wedge block 47 with respect to the cylindrical insert 45 and axially provided with a threaded hole 50;

a second threaded element 51, passing through an axial hole 52 open on the first wedge block 47 and on the first tongue 47*a* and adapted to be screwed to the threaded hole 50 on the second wedge block 49 for blocking the first wedge block 47 to the arm 17, and for pulling the second wedge block 49 to compress the cylindrical tubular insert 45 between the two wedge blocks 47 and 49.

The rigid connection device 27 allows an installer to adapt the rod 25 to the height of the shutter 12 to which it is fitted.

The rod 25 provided to the installer, of a standard length, is brought to size by sawing, and thereafter is fixed to the second arm 17 by means of the device 27.

The device 27 insures a stable connection between the two components and avoids that the installer must carry out welding operations, that are expensive, difficult and risky due to the deformations and strains that the welding may provoke on such components.

The means for adjusting the distance between the two jambs 18 and 19 of the frame 15 are constituted by a second plate-shaped element 53, rigidly coupled to the second jamb 19 and adapted to be inserted, at the end of the profiled element defining the guide 13, in the longitudinal grooves 31.

The second plate-shaped element 53 is fixed by means of a further third threaded element 54 passing through corresponding holes 55 on the two facing vertical walls 37 of the profiled element, in proximity to the region in which the second plate-shaped element 53 is inserted.

The third threaded element 54, in the same manner as the first threaded element 35, is adapted to tightly hold the profiled element locking the plate-shaped element 53 between the two facing wings 30.

Figure 3:
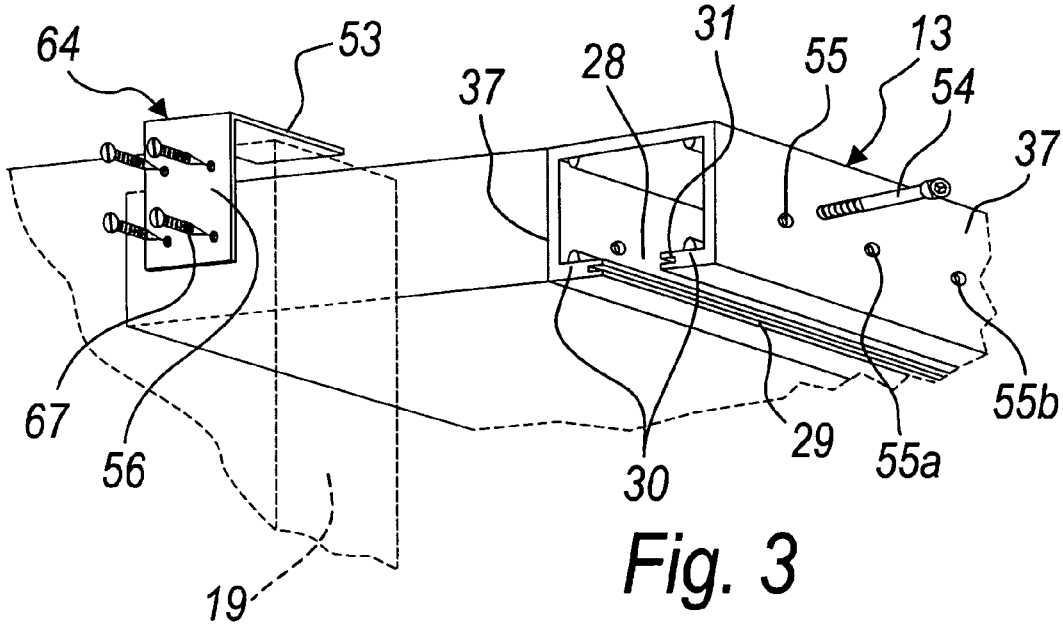
FIG. 3 is an exploded perspective view of a second detail of the mechanism according to the invention.
Figure 4:
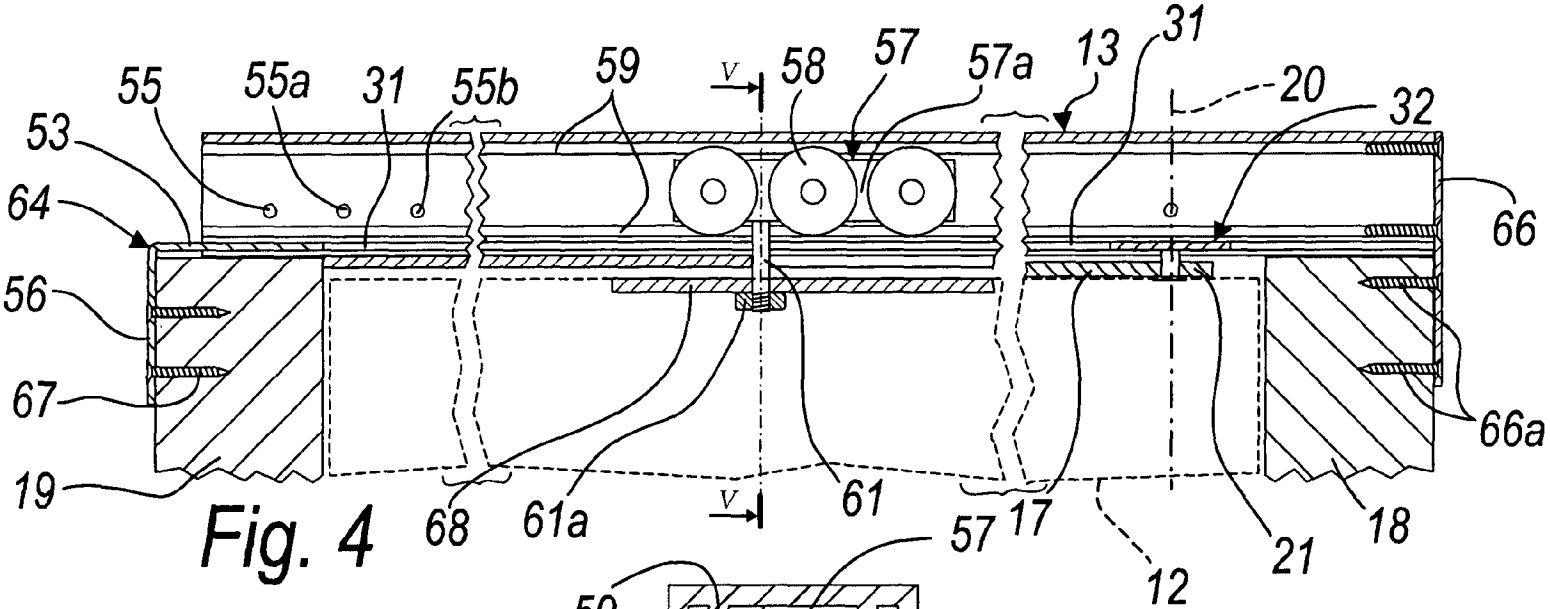
FIG. 4 is a front sectional view of a third detail of the mechanism according to the invention.
Figure 5:
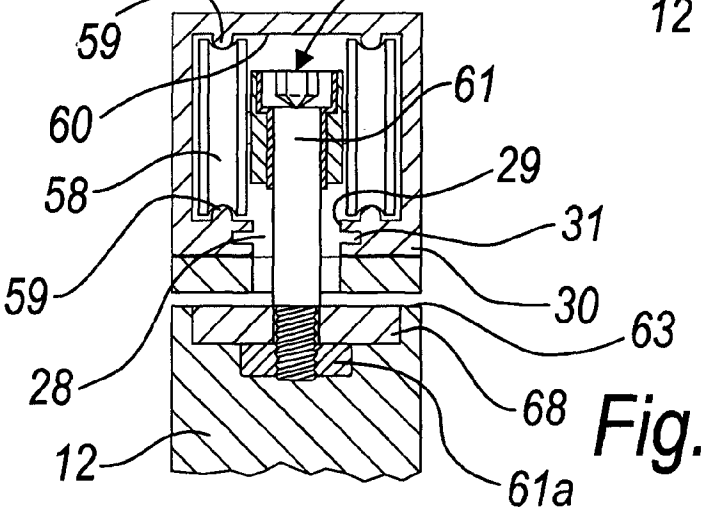
FIG. 5 is a sectional view taken along the line V-V of FIG. 4.
Figure 6:
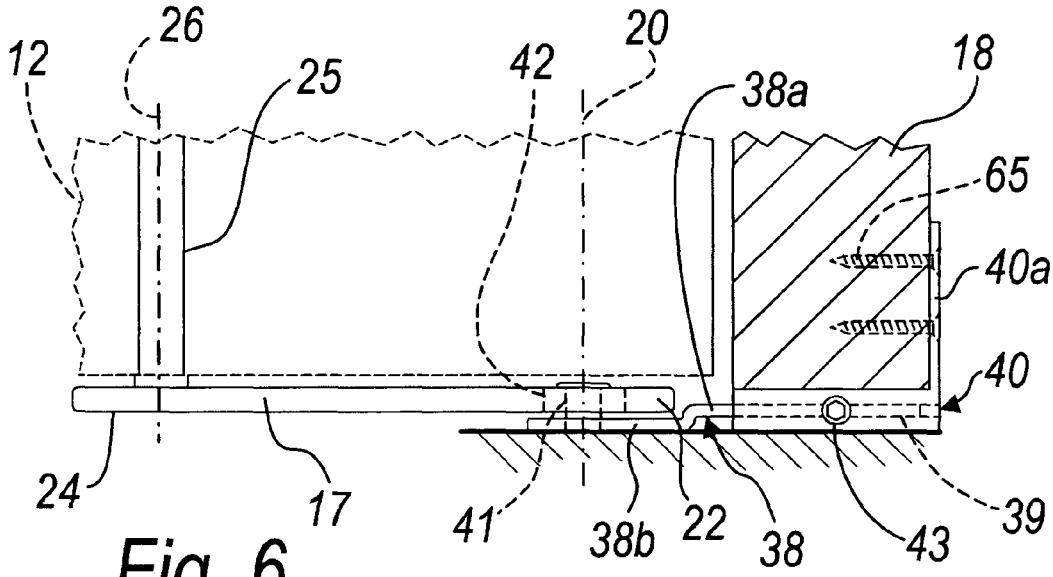
FIG. 6 is a partial sectional side view of a further detail of the invention.

The profiled element has, at the area of insertion of the second plate-shaped element 53, a plurality of pairs of facing holes, indicated with the reference numerals 55, 55*a* and 55*b* in FIGS. 3 and 4, to one of which the third threaded element 54 can be connected, such pair of holes being selected according to the chosen length of the profiled element and according to the position determined for the plate-shaped element 53 with respect to said profiled element.

The installer, once the distance between the jambs is determined, proceeds to size the profiled element, provided with a standard length.

The second plate-shaped element 53 is fixed inside the profiled element by inserting the third threaded element 54 in the pair of holes 55 or 55*a* or 55*b* closest to its position.

The second plate-shaped element 53 is part of an L-shaped bracket 64, whose remaining portion 56, perpendicular to the plate-shaped element 53, is designed for fixing, for example by means of screws 67, to the jamb 19.

At the opposite part with respect to the L-shaped bracket 64, the profiled element defining the guide 13 is blocked in a stable manner to the first jamb 18 by means of a plate 66 and by a plurality of screws 66*a*.

In a variation of this first embodiment of the invention, not illustrated for the sake of simplicity, at the opposite part with respect to the L-shaped bracket 64, the profiled element defining the guide 13 is connected to the first jamb 18 by means of further means for adjusting the distance between the two jambs 18 and 19 as those just described, i.e. by means of a second identical L-shaped bracket 64, comprising a second plate-shaped element 53 to be inserted in the opposite end of the guide 13, and a portion 56 for fixing to the first jamb 18, in a manner completely similar to that described for the connection between the second jamb 19 and the guide 13.

The sliding means for the first pivot means are constituted by a carriage 57 provided with six wheels 58, arranged to slide inside the guide 13.

Four longitudinal ribs 59 are provided inside the profiled element forming the guide 13, two of which protrude symmetrically towards the inside of the internal upper surface 60 and two protrude from the wings 30, each defining a rail for the anti-derailment and anti-blocking sliding of the carriage 57.

Of the six wheels 58 of the carriage 57, four are bearing and two are driving on the upper ribs 59 in order to avoid the rotation and the blocking of the carriage 57.

The first pivot means are formed by a further pivot 61 exiting from the body 57*a* of the carriage 57, and adapted to be inserted on the facing upper edge 63 of the shutter 12.

The pivot 61 is provided as a threaded element.

In the present embodiment of the invention, the further pivot 61 crosses a plate 68 adapted to be applied on the edge 63 of the shutter 12 and also having a hole for the passage of the rod 25.

The threaded element forming the pivot 61 is fixed to the plate 68 by means of a counter-arranged nut 61*a* that is lodged between the plate 68 and the edge 63.

Figure 8:
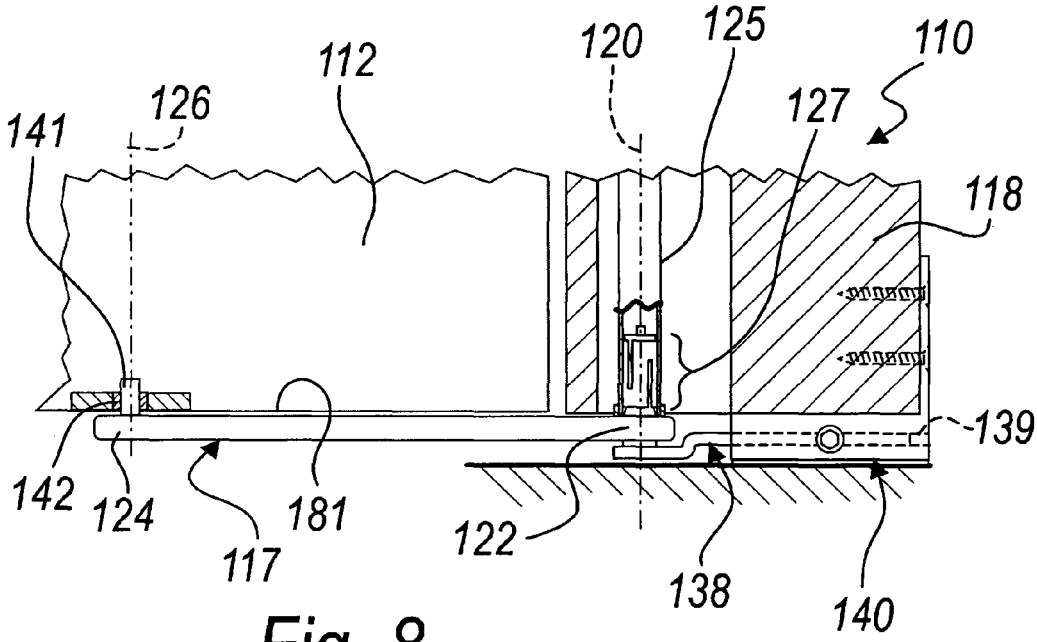
FIG. 8 is a sectional side view of the mechanism according to the invention in a second embodiment.
Figure 9:
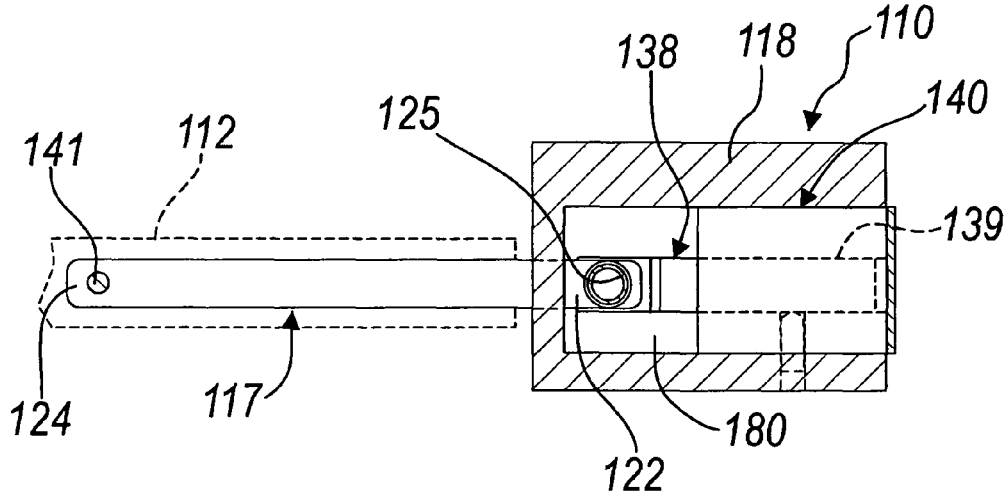
FIG. 9 is a sectional top view of the mechanism according to the invention in the second embodiment of FIG. 8.
Figure 10:
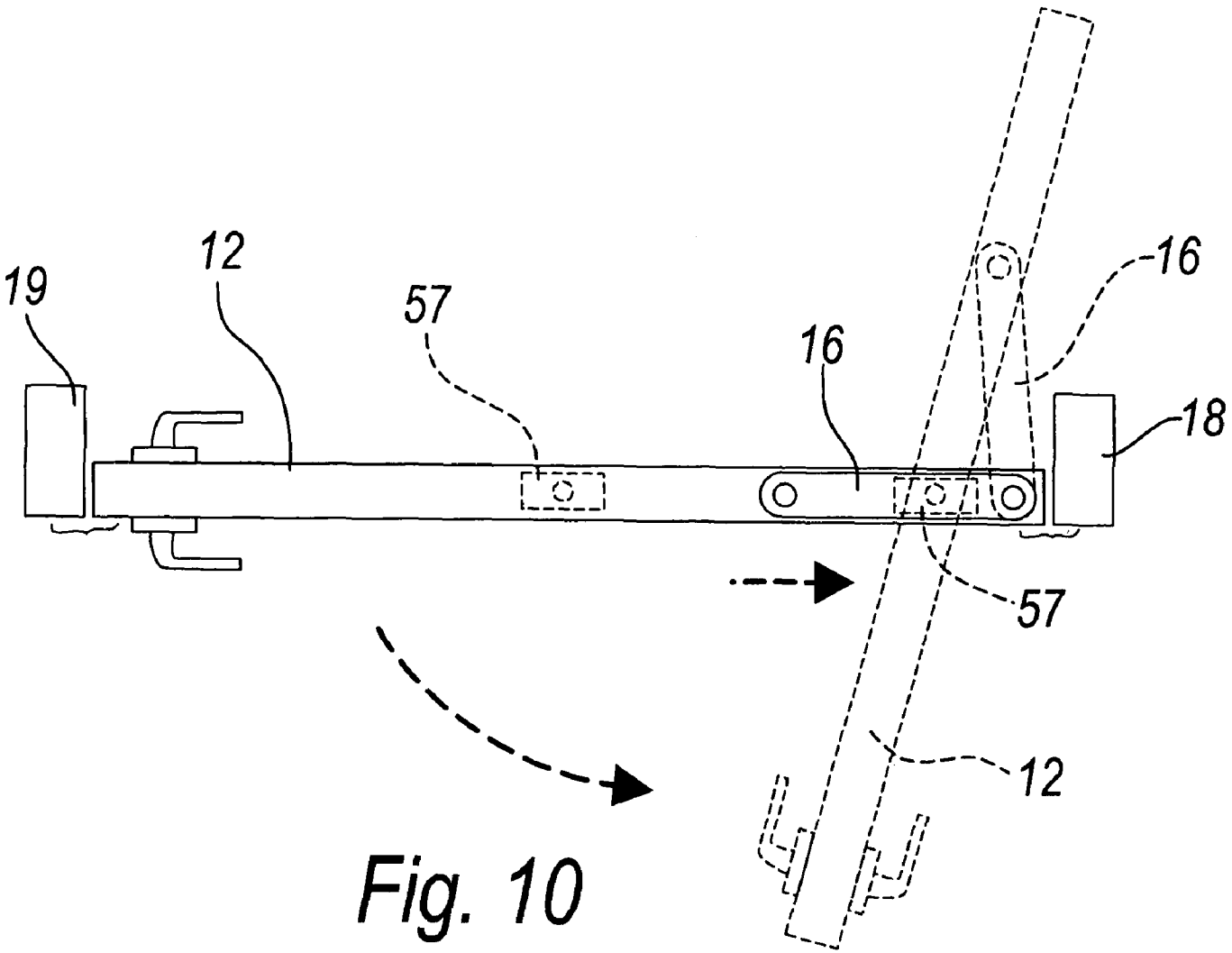
FIG. 10 is a schematic top view of the movement of the shutter that the mechanism according to the invention allows to perform.

In a second embodiment, illustrated in FIGS. 8 and 9 and designated by the reference numeral 110, the mechanism has the tubular rod 125, completely equivalent to the rod 25 of the first embodiment, inserted in the jamb 118 to define the second rotation axis 120.

The rod 125 is rigidly coupled to the first ends of two arms (in FIG. 8 the first end 122 of the second lower arm 117 is shown) instead of to the second ends 23, 24, as in the first embodiment of the mechanism 10.

The tubular rod 125 is positioned within a space 180 inside the jamb 118 and is fixed to the first plate-shaped element 138 arranged below by means of the rigid connection device 127.

The space 180 has dimensions such as to allow the movement of the tubular rod 125 therein; as in the first embodiment of the mechanism 10, in fact, the first plate-shaped element 118 is slideable inside the opening 139 towards the inside or towards the outside of the plinth 140.

The second arm 117 is fixed to the shutter 112 by means of a cylindrical body 141 protruding upward from the first end 124 of the second arm 117, the cylindrical body 141 being inserted in a counter-shaped second rotation ring 142 rigidly coupled to the lower edge 181 of the shutter 112.

The cylindrical body 141, with a further equivalent coaxial cylindrical body, not illustrated, protruding from the first end of the first upper arm, forms the third rotation axis 126.

In practice it has been found that the invention thus described solves the intended aim and objects; in particular the present invention provides a mechanism for the installation of a door or other similar closure having a rotational-sliding movement that with few and simple mechanical processes may be adapted to doors or other closures having different sizes.

Moreover, the present invention provides a mechanism that allows an easy registration of the position of the shutter with respect to the jambs.

Further, the present invention provides a mechanism that is arrangeable in any position with respect to the width of the wall in which the door is installed.

Also, the present invention provides a mechanism that is applicable to shutters having different heights.

Moreover, the present invention provides a mechanism that can be easily installed even by users not provided with particular skills.

The present invention also provides a mechanism that can be manufactured economically with known systems and technologies.

The invention thus conceived is susceptible of numerous modifications and variations, all of which are within the scope of the appended claims; moreover, all of the details may be replaced with other technically equivalent elements.

In practice, the materials employed, as well as the dimensions, as long as compatible with the specific use, may be any according to requirements and to the state of the art.

The disclosures in Italian Patent Application No. PD2005A000275 from which this application claims priority are incorporated herein by reference.

What is claimed is:

1. A mechanism for the installment of a shutter having a rotational-sliding movement to a frame, the mechanism comprising:

a guide connected to a horizontal strut of said frame;

a translation element slidably arranged in said guide;

a first pivot mechanism that pivotally connects a central region of said shutter to said translation element about a first vertical axis;

an upper arm having a first end and a second end;

a lower arm having a first end and a second end;

a second pivot mechanism that pivotally connects the first ends of said upper and lower arms to the frame adjacent to a first jamb of the frame about a second vertical axis, the second ends of said upper and lower arms being rigidly coupled to a rod running an entire height of the shutter, rotating about a third vertical axis, said third vertical axis being interposed between the first vertical axis and the second vertical axis, said second pivot mechanism providing an adjustment of a distance of said second rotation axis from the first jamb of the frame, said second ends of said upper and lower arms being reciprocally rigidly connected by said rod, and said rod being fixed to at least one of the upper and lower arms with a rigid connection device providing a non-welded joint between the rod and the at least one of the upper and lower arms.

2. The mechanism of claim 1, further comprising an adjuster for adjusting the distance between said first jamb of the frame and a second jamb of the frame.

3. The mechanism of claim 1, wherein said horizontal strut is an upper strut and said guide is constituted by a profiled element rigidly coupled to the upper strut and having a substantially C-shaped cross section, with an opening directed downward, a longitudinal groove being provided on each one of facing edges of wings of the profiled element forming said opening.

4. The mechanism of claim 3, wherein said second pivot mechanism, providing an adjustment of a distance of said second rotation axis from the vertical jamb of the frame, comprises, for the upper arm, a plate of which two opposite perimetral portions are adapted to be inserted in said facing longitudinal grooves, a cylindrical body protruding from said plate and inserted in a counter-shaped rotation ring rigidly coupled to said first end of said upper arm, said plate being movable in said grooves in a longitudinal extension direction of said profiled element, for adjusting to a chosen position, such chosen position being fixable by means of a threaded element passing through corresponding holes on two facing vertical walls of the profiled element at a region in which said plate is inserted, said threaded element tightly holding the profiled element by locking said plate between two facing wings of said profiled element.

5. The mechanism of claim 4, wherein said second pivot mechanism, providing an adjustment of a distance of said second rotation axis from the vertical jamb of the frame, further comprises, for the lower arm, a planer element inserted with a first part thereof inside an opening of a plinth fixed below the jamb of the frame and protruding with its remaining second part to support a cylindrical body inserted in a counter-shaped rotation ring rigidly coupled to an end of said lower arm, said plate-shaped element being slideable inside said opening towards the inside or towards the outside of said plinth for positioning said cylindrical body, said position being fixed by means of a threaded element screwed in a counter-threaded hole provided on said plinth and open on said opening with the axis traverse to the longitudinal direction of said opening, said threaded element being screwed until it presses against a side of said first part of said plate-shaped element.

6. The mechanism of claim 1, wherein said rigid connection device is constituted by an expanding cylindrical tubular insert with longitudinal grooves open on the ends, to which there are coaxially associated:

a first frustum-shaped wedge block, inserted in an end of the rod with a conical part facing the cylindrical tubular insert, and provided with an anti-rotation tongue protruding, from said rod and inserted in a counter-shaped seat open on the corresponding end of said at least one of the upper and lower arms;

a second frustum-shaped wedge block, opposite to said first wedge block with respect to the cylindrical ,insert and axially provided with a threaded hole;

a threaded element, passing through an axial hole open on said first wedge block and on its tongue and adapted to be screwed to said threaded hole on said second wedge block for blocking the first wedge block to the at least one of the upper and lower arms, and for pulling the second wedge block to compress the cylindrical tubular insert between said two wedge blocks, a portion of the end of said rod, in which said cylindrical insert, said first wedge block and said second wedge block are inserted, being tubular with a circular cross-section.

7. The mechanism of claim 3, further comprising an adjuster for adjusting the distance between said first jamb of the frame and a second jamb of the frame which are constituted by a planer element, rigidly coupled to one of the two jambs and adapted to be inserted, at the end of the profiled element defining the guide, in said longitudinal grooves, and fixed thereto by means of a threaded element passing through corresponding holes on two facing vertical walls of the profiled element, at an area in which said planer element is inserted, said threaded element tightly holding the profiled element locking said planer element between said two facing wings.

8. The mechanism of claim 7, wherein said profiled element has, at a region of insertion of the planer element for adjustment of the distance between the two jambs, a plurality of pairs of facing holes, to one of which said threaded element can be connected, selected according to a chosen length of the profiled element and according to a position determined for the planer element with respect to said profiled element.

9. The mechanism of claim 8, wherein said plate-shaped element is part of an L-shaped bracket, whose remaining portion, perpendicular to the planer element to be inserted in the end of the profiled element, is for fixing to the first jamb.

10. The mechanism of claim 9, wherein at an opposite part with respect to the L-shaped bracket, the profiled element defining the guide is stably blocked to the first jamb by means of a plate and by a plurality of screws.

11. The mechanism of claim 9, wherein at an opposite part with respect to the L-shaped bracket, the profiled element defining the guide is coupled to the first jamb by a second adjuster for adjusting the distance between the two jambs.

12. The mechanism of claim 11, wherein said second adjuster for adjusting the distance between the two jambs is constituted by a second identical L-shaped bracket, comprising a second planer element to be inserted in the opposite end of the guide, and a portion for fixing to the first jamb.

13. The mechanism of claim 1, wherein said rod is constituted by a tubular profiled element having a circular cross-section.

14. The mechanism of claim 3, wherein said translation element comprises a carriage with at least four wheels, arranged to slide inside said guide.

15. The mechanism of claim 14, wherein inside the profiled element forming the guide, four longitudinal ribs are provided which protrude symmetrically towards the inside of an internal upper surface and from the wings, each defining a rail for anti-derailment and anti-blocking sliding of said carriage inside the guide.

16. The mechanism of claim 14, wherein said first pivot Mechanism comprises a pin exiting from the body of said carriage, and adapted to cross a plate arranged on the facing upper edge of the shutter, said pin being threaded at its end, and being fixed to said plate by means of an anti-screwing nut screwed to said thread at the end of the pin.

17. A shutter with a rotational-sliding movement, in combination with the mechanism according to claim 1.

* * * * *